United States Patent [19]

Guinn

[11] Patent Number: 4,549,949

[45] Date of Patent: Oct. 29, 1985

[54] MARINE PROPULSION DEVICE INCLUDING CATHODIC PROTECTION

[75] Inventor: Douglas B. Guinn, Shorewood, Wis.

[73] Assignee: Outboard Marine Corporation, Waukegan, Ill.

[21] Appl. No.: 618,370

[22] Filed: Jun. 7, 1984

[51] Int. Cl.[4] ..... C23F 13/00

[52] U.S. Cl. ..... 204/197; 204/148; 204/286; 416/93 A; 416/244 B; 416/247 A; 440/49; 440/78

[58] Field of Search ..... 204/147, 148, 196, 197, 204/286; 416/93 A, 93 M, 244 B, 247 A; 440/49, 76, 78

[56] References Cited

U.S. PATENT DOCUMENTS

| | | | |
|---|---|---|---|
| 1,842,541 | 1/1932 | Cumberland | 204/147 |
| 2,666,026 | 1/1954 | Gibbs | 204/197 |
| 2,732,021 | 1/1956 | Taft | 204/197 |
| 3,169,504 | 2/1965 | Gruber | 204/196 |
| 3,240,180 | 3/1966 | Byrd | 204/196 |
| 3,330,751 | 7/1967 | Warner | 204/196 |
| 3,660,264 | 5/1972 | Schuller | 204/197 |
| 3,726,779 | 4/1973 | Morgan | 204/197 |
| 4,140,614 | 2/1979 | McKie | 204/197 |
| 4,146,448 | 3/1979 | Nakano et al. | 204/197 |
| 4,196,064 | 4/1980 | Harms et al. | 204/147 |
| 4,486,181 | 12/1984 | Cavil | 440/49 |

*Primary Examiner*—T. Tung

*Attorney, Agent, or Firm*—Michael, Best & Friedrich

[57] ABSTRACT

The marine propulsion device lower unit includes a housing having a lower portion submerged in water and defining an internal passage communicating with the water. Corrosion protection for both internal and external parts of the lower unit is provided by a sacrificial, galvanic-type anode mounted on the submerged portion of the housing and including a first or outer portion having a surface exposed to water exterior to the lower unit and a second or inner portion having a surface exposed to water present in the passageway.

9 Claims, 4 Drawing Figures

MARINE PROPULSION DEVICE INCLUDING CATHODIC PROTECTION

BACKGROUND OF THE INVENTION

This invention relates to lower units for marine propulsion devices, such as outboard motors and stern drive units, and, more particularly, to such lower units including anodes for cathodic protection.

When marine propulsion devices are operated in sea water, a galvanic action between parts of dissimilar metals exposed to electrolytic sea water can cause severe corrosion of the less noble metal, particularly aluminum. Anodes have been used to reduce the corrosive effect caused by this galvanic action.

Examples of prior art patents disclosing the use of anodes on marine propulsion devices for this purpose include the following U.S. patents:

| Patentee | U.S. Pat. No. | Issue Date |
|---|---|---|
| Gruber | 3,169,504 | February 16, 1965 |
| Byrd | 3,240,180 | March 15, 1966 |
| Warner | 3,330,751 | July 11, 1967 |
| Nakano | 4,146,448 | March 27, 1979 |
| Harm et al | 4,196,064 | April 1, 1980 |
| Ciampolillo | 4,391,567 | July 5, 1983 |

Attention is also directed to the pending U.S. Cavil Application Ser. No. 365,295 filed Apr. 5, 1982 and the pending U.S. Cavil et al Application Ser. No. 531,462, filed Sept. 12, 1983.

SUMMARY OF THE INVENTION

The invention provides a lower unit for a marine propulsion device including a housing having a lower portion normally submerged in water and defining an internal passage communicating with the water, and a sacrificial, galvanic-type anode mounted on the submerged lower portion of the housing. The anode includes a first portion having an outer or first surface which is exposed to water exterior to the housing and an inner or second portion having a second surface which is exposed to water present in the passageway.

In one embodiment, the housing includes a drive shaft housing having a lower end, a gear case connected to the lower end of the drive shaft housing and carrying a rotatable propeller, and the sacrificial anode is mounted on the gear case at a location above the rotational axis of the propeller.

In one embodiment, the gear case includes a streamlined strut having a leading surface, and a laterally extending, horizontal flange with a rounded nose portion extending forwardly of the strut leading surface. The flange nose portion has a rounded leading edge and the outer portion of the sacrificial anode includes a leading edge having a contour generally conforming to the contour of the leading edge of the flange nose portion.

In one embodiment, the gear case has an upper edge and the drive shaft housing has a lower edge including a notch cooperating with the gear case upper edge to define a slot through which the inner portion of the sacrificial anode extends for exposure to water in the passageway.

In one embodiment, the sacrificial anode has a horseshoe-like shape including a thickened portion having a lower edge resting on the flange and forming the anode outer portion and also including a thinner portion extending through the slot in the drive shaft housing and forming the anode inner portion.

In one embodiment, means accessible from the exterior of the lower unit are provided for removably securing the sacrificial anode on the lower housing or unit.

One of the principal features of the invention is the provision of a marine propulsion device having a lower unit including means for providing cathodic protection against corrosion of both internal and external parts in the area of the joint between the drive shaft housing and the gear case.

Another of the principal features of the invention is the provision of a marine propulsion device wherein such corrosion protection means can be externally and conveniently removed and replaced.

Another of the principal features of the invention is the provision of a marine propulsion device wherein such corrosion protection means requires minimum modification to existing constructions and can be installed and removed without disassembly of the lower unit.

Other features, aspects and advantages of the invention will become apparent to those skilled in the art upon reviewing the following detailed description, the drawings and the appended claims.

Figure 1:
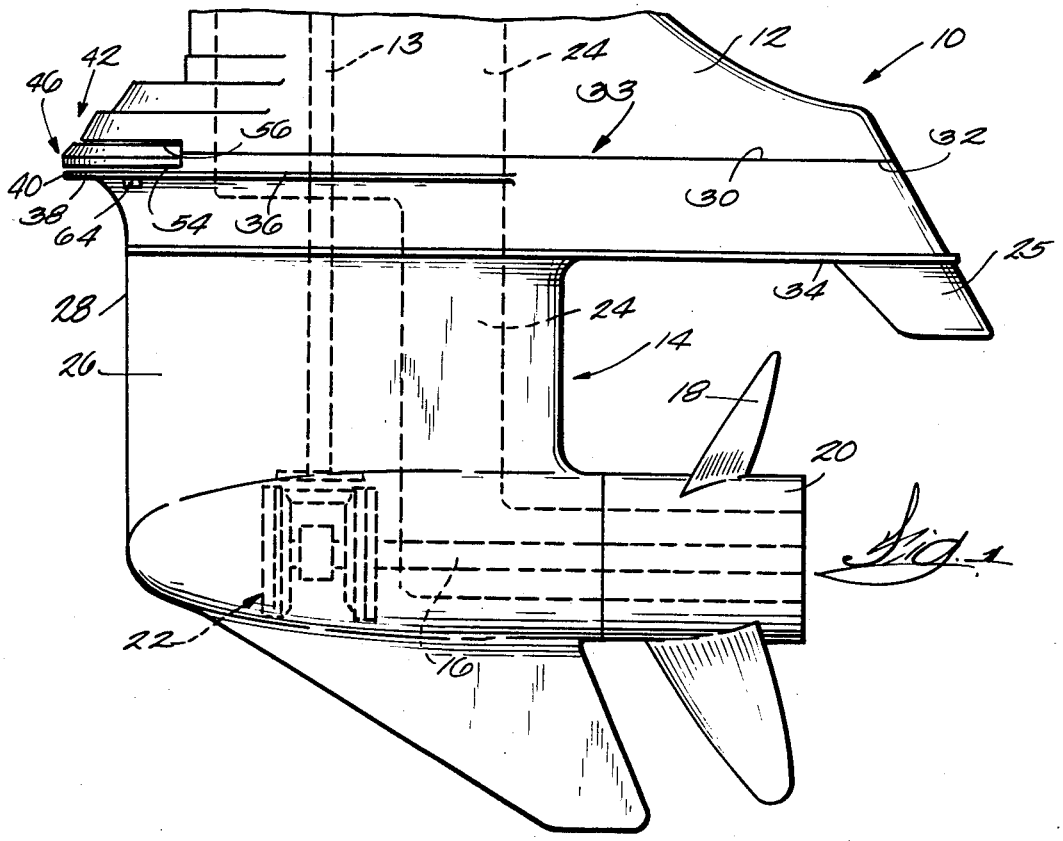
FIG. 1 is a fragmentary, side elevational view, partially schematic, of the lower unit of a marine propulsion device incorporating various of the features of the invention.
Figure 2:
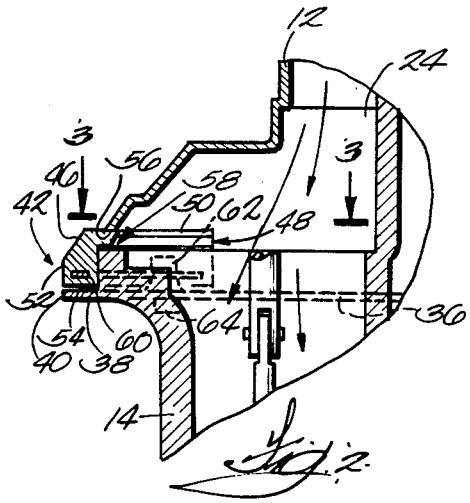
FIG. 2 is an enlarged fragmentary, sectional view of a forward portion of the lower unit showing installation of the sacrificial anode.
Figure 3:
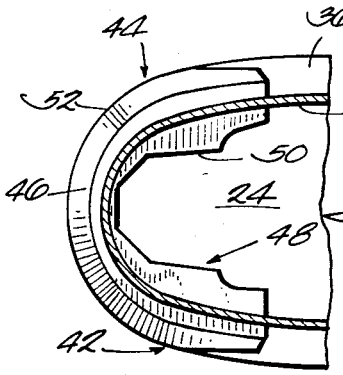
FIG. 3 is a sectional view taken generally along line 3—3 in FIG. 2 with internal parts omitted for the sake of clarity.
Figure 4:
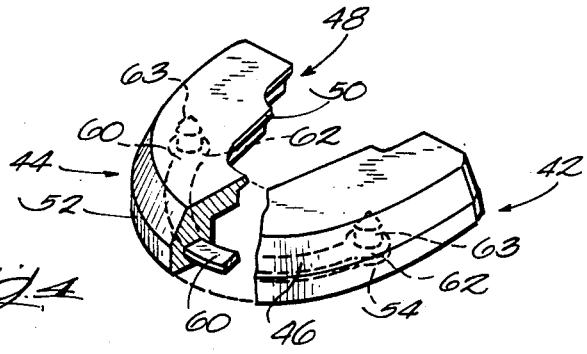
FIG. 4 is an enlarged perspective view, partially broken away, of the sacrificial anode.

Before explaining at least one of the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Illustrated in the drawing is a lower housing or unit 10 of marine propulsion device which can be either a stern drive unit or an outboard motor. In the specific construction illustrated, the marine propulsion device is a stern drive unit and the lower unit 10 includes a drive shaft housing 12 supporting a rotatable drive shaft 13. The lower end of the drive shaft housing 12 is connected by suitable means to a gear case 14 supporting a rotatable propeller shaft 16 carrying a propeller 18 which includes a hub 20 and is located rearwardly of the aft end of the gear case 14. The drive shaft 14 is drivingly connected to the propeller shaft 16 through a conventional transmission 22 housed in the gear case 14.

The drive shaft housing 12 and the gear case 14 define a passageway 24 through which engine exhaust gases flow and are discharged into the water, either through the propeller hub 20 or through openings (not shown) in the aft end of the gear case 14. Other arrangements, such as an exhaust snout 25 communicating with the passageway 24 can also be employed.

The gear case 14 has a streamlined strut 26 having a curved leading edge or surface 28 which, at its upper end, is curved forwardly. The gear case also includes an upper edge 30 which adjoins a lower edge 32 on the drive shaft housing 12 along a joint 33. Extending laterally from the strut 26 below the joint 33 between the drive shaft housing 12 and the gear case 14 and above the propeller 20 is a horizontally extending anti-cavitation plate 34 which extends rearwardly over the propeller 20. The gear case 14 also includes a laterally extending, horizontal flange 36 located below and relatively close to the joint 33 between the drive shaft housing 12 and the gear case 14. The flange 36 includes a nose portion 38 extending forwardly from the leading surface 28 of the strut 26 and having a rounded leading edge 40.

The gear case 14 and at least the lower portion of the drive shaft housing 12 are submerged in water when the boat is in the water. When this portion of the lower unit 10 is submerged and the boat engine is not operating, sea water backs up through the passageway 24 and contacts internal parts of the gear case 14 and the drive shaft housing 12 exposed to the passageway 24.

The drive shaft housing 12 and the gear case 14 are made from aluminum and parts thereof exposed to sea water are subject to corrosion. Corrosion of some internal parts can become severe enough to make disassembly difficult, if not impossible, and/or cause component failure. A sacrificial anode mounted on the exterior of the lower unit 10 does not provide adequate protection against corrosion of such internal parts.

For protection against corrosion of both internal and external parts of the lower unit 10, particularly internal parts located in the upper portion of the lower unit 10, there is provided a sacrificial, galvinic-type anode 42 including a portion exposable to sea water outside the lower unit 10 and another portion exposed to sea water in the passageway 24. The sacrificial anode 42 is made from zinc or other suitable sacrificial anode material and is mounted in direct physical contact with the aluminum metal surfaces, rather than being electrically insulated and connected to a source of electrical energy as is the case with more permanent type anodes.

The sacrificial anode 42 is arranged so that it can be conveniently mounted on the gear case shroud 26 or the drive shaft housing 12 with portions exposed to water outside the lower unit 10 and inside the passageway without requiring disassembly and/or substantial modification to existing constructions. Toward this end, the sacrificial anode 42 preferably has a horseshoe-like shape including a thickened first or outer portion 44 having a first or outer surface 46 which is exposed to outside water and a thinner second or inner portion 48 which extends inwardly from the top of the outer portion 44 and has a second surface 50 which is exposed to water inside the passageway. The outer portion 46 of the sacrificial anode 42 includes a forward or leading edge 52 having a contour generally conforming with the leading edge 40 of the flange nose portion 38. The outer portion 46 of the sacrificial anode 42 also includes a lower edge 54 which rests on the flange 36.

To minimize modifications to existing constructions and facilitate installation and removal of the sacrificial anode 42 without disassembly of the lower unit 10, the inner portion 48 preferably is dimensioned to fit through a slot or the like which is located in the drive shaft housing 12 or the gear case 14 and which communicates with the passageway 24. In the specific construction illustrated, the lower edge 32 of the drive shaft housing 12 includes a notch 56 which cooperates with the upper edge 30 of the gear case 14 to define a slot 58 through which the inner portion 48 of the sacrificial anode 42 extends with the inner surface 50 exposed to the passageway 24.

The sacrificial anode 42 is chemically attached and eventually can corrode away to the point where it must be replaced. Accordingly, means preferably are provided for removably securing the sacrificial anode 42 to the lower unit 10 so that a partially corroded one can be conveniently removed and replaced with a new one. In the specific construction illustrated, a generally U-shaped insert 60 including a pair of threaded apertures 62 is cast into the body of the sacrificial anode 42. The insert 60 is made from a material, such as an aluminum alloy, which is more noble than that of the sacrificial anode 42 so the insert 60 will not corrode. In addition to serving as a mount for the sacrificial anode 42, the insert 60 provides structural support for the sacrificial anode 42 as the sacrificial anode 42 is secured in place by a pair of bolts 64 extending through apertures in the flange 36 and threaded into apertures 62 located in bosses 63 provided near the ends of the insert 60. Thus, a used sacrificial anode 42 can be readily replaced by simply moving the bolts 64 which are accessible from the exterior of the lower unit 10, slipping the sacrificial anode 42 off the flange 36, slipping a new one into place, and re-installing bolts 64.

By virtue of the sacrificial anode 42 having portions exposed to sea water both inside and outside the lower unit 10, a single sacrificial anode provides corrosion protection for both external and internal parts of the drive shaft housing 12 and the gear case 14, particularly such parts located in the area of the joint between the drive shaft housing 12 and the gear case 14.

Various of the features are set forth in the following claims:

I claim:

1. A lower unit for a marine propulsion device comprising a housing having a lower portion with an outer surface which is normally submerged in water and with an inner surface defining an internal passage which communicates with the water and which is exposed to water when the lower portion is submerged in water, and a sacrificial anode mounted on said submerged lower portion of said housing and including a first portion having a first surface which constitute a part of said outer surface of said lower portion and which is exposed to water exterior to said housing and a second portion having a second surface which constitutes a part of said inner surface of said lower portion and which is exposed to water present in said passageway.

2. A lower unit according to claim 1 wherein said housing includes a drive shaft housing having a lower end and a gear case connected to said lower end of said drive shaft housing and carrying a rotatable propeller and wherein said sacrificial anode is mounted on said gear case at a location above the rotational axis of said propeller.

3. A lower unit according to claim 2 wherein said gear case includes a streamlined strut having a leading surface, and a laterally extending, horizontal flange with a nose portion extending forwardly of said leading surface, said nose portion having a rounded leading edge, and wherein said first portion of said sacrificial anode has a leading edge having a contour generally conforming to the contour of said leading edge of said flange nose portion.

4. A lower unit according to claim 2 wherein said gear case has an upper edge, and wherein said drive shaft housing has a lower edge including a notch cooperating with said upper edge of said gear case to define a slot which receives said sacrificial anode.

5. A lower unit according to claim 4 wherein said sacrificial anode has a horseshoe-like shape including a thickened portion having a lower edge resting on said flange and forming said first anode portion and also including a thinner portion forming said second anode portion.

6. A lower unit according to claim 2 including means accessible from the exterior of said lower unit for removably securing said sacrificial anode on said gear case.

7. A lower unit according to claim 1 including means accessible from the exterior of said housing for removably securing said sacrificial anode to said housing.

8. A lower unit according to claim 7 wherein said housing includes a flange, wherein said securing means includes an insert which is of more noble material than the material of said anode and which is located inside said anode and including an opening for receiving a removable fastener, and a fastener extending through an aperture in said flange and removably secured in said insert opening.

9. A lower unit according to claim 1 wherein said lower unit includes a drive shaft housing connected to a gear case and wherein said anode is located adjacent the connection between said drive shaft housing and said gear case.

* * * * *